US007789627B2

(12) United States Patent
Chiang et al.

(10) Patent No.: US 7,789,627 B2
(45) Date of Patent: Sep. 7, 2010

(54) CENTRIFUGAL IMPELLER

(75) Inventors: Chung-Ping Chiang, Hsinchu Hsien (TW); Jiing Fu Chen, Hsinchu Hsien (TW); Yung-Lo Chow, Hsinchu Hsien (TW); Cheng-Chung Yen, Hsinchu Hsien (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 988 days.

(21) Appl. No.: 11/524,321

(22) Filed: Sep. 21, 2006

(65) Prior Publication Data

US 2007/0140832 A1 Jun. 21, 2007

(30) Foreign Application Priority Data

Dec. 15, 2005 (TW) ..... 94144403 A

(51) Int. Cl.
*F01D 5/00* (2006.01)

(52) U.S. Cl. ..... 416/144; 416/182; 416/203

(58) Field of Classification Search ..... 416/144, 416/145, 182, 203, DIG. 5
See application file for complete search history.

(56) References Cited

U.S. PATENT DOCUMENTS 3,635,579 A 1/1972 Wood
4,411,592 A 10/1983 Traver et al.
4,504,188 A 3/1985 Traver et al.
4,538,963 A * 9/1985 Sugio et al. ..... 416/203
5,249,919 A 10/1993 Sishtla et al.
6,149,381 A * 11/2000 Lee ..... 415/53.1
6,345,951 B1 * 2/2002 Choi ..... 415/1
6,514,036 B2 * 2/2003 Marshall et al. ..... 415/98
2006/0275127 A1 * 12/2006 Borufka et al. ..... 416/203
2008/0101936 A1 * 5/2008 Lee et al. ..... 416/203

FOREIGN PATENT DOCUMENTS

GB 2046360 A * 11/1980
TW M255650 1/2005

* cited by examiner

*Primary Examiner*—Edward Look
*Assistant Examiner*—Aaron R Eastman
(74) *Attorney, Agent, or Firm*—Rabin & Berdo, P.C.

(57) ABSTRACT

A centrifugal impeller employed in a centrifugal machine, includes a main body, the main body generally being conical and defining a shaft bore in a center portion thereof; and a plurality of blade groups evenly arranged surrounding the shaft bore in sequence, each of the blade groups having a plurality of blades wherein neighboring blades having an interval angle, and the number and corresponding interval angles of the blades of different blade groups are identical. The present impeller structure can be employed to distribute the concentrated energy of the discrete tones noise of the blades, which is generated by the high-speed rotation impeller, and further to reduce the operating tones noise.

9 Claims, 9 Drawing Sheets

CENTRIFUGAL IMPELLER

FIELD OF THE INVENTION

The present invention relates to a centrifugal impeller, especially to a low noise centrifugal impeller employed in centrifugal type of turbomachinery.

BACKGROUND OF THE INVENTION

Centrifugal type of turbomachinery, such as centrifugal compressors, centrifugal pumps or centrifugal fans, adopts a centrifugal machine to impel working fluid. In general, a centrifugal machine consists of two principal parts: an impeller(s), which forces the working fluid to flow into a rotary motion by impelling action, and a volute casing, which directs the working fluid to the impeller(s) and leads the working fluid away under a higher pressure. A general structure of a conventional centrifugal machine 1 is as shown in FIG. 1. The centrifugal machine 1 comprises a suction chamber 11, a centrifugal impeller 12, a diffuser 13, a volute casing 14 and an impeller shaft 15. In the operation thereof, a working fluid enters the centrifugal machine 1 via the suction chamber 11. The impeller shaft 15 is driven to rotate the centrifugal impeller 12 at high speed for enhancing the kinetic energy of the working fluid. Therefore the kinetic energy of the accelerated working fluid can be converted into pressure energy via the deceleration and diffusion function of the diffuser 13 and the volute casing 14, and the higher pressure working fluid can further be ejected from the outlet of the centrifugal machine 1.

However, for the operation of the centrifugal machine 1, the pressure variation of the working fluid flowing with high velocity and the blades rotated at high speed will resulted in considerable noises. Generally, the noises contain high level tonal noises which will affect people's hearing. The aforementioned centrifugal impeller 12 is shown in FIGS. 2A and 2B. A plurality of blades 121 is arranged on the main body of the impeller 122, wherein the plurality of blades 121 surrounds the outer circumference of the main body of the centrifugal impeller 122, and the blades are arranged equiangularly (A1) and axisymmetrically to the shaft bore 123 (for passing through the impeller shaft 15). Consequently, when the working fluid flows from the inlet to the outlet of the impeller 12 via the passage, the diffuser 13 and volute casing 14, the noises will be generated due to periodical pressure and velocity pulsation caused by the rotation effect of impeller 12 and the geometry effect of blades 122. As shown in the noise spectrum in FIG. 3, the noise spectrum is distributed on the dominant frequency, the blade passing frequency, (the rotation speed of the impeller multiplied by the number of the blades) and harmonic frequencies of the centrifugal impeller. Generally, there is a considerably concentrated noise energy on the blade passing frequency of the impeller. This is why the operation of conventional centrifugal impellers always has a very high noise level. The noises caused by the centrifugal machine mainly comprise broadband noise and discrete tones noise. The broadband noise is generated because of the pressure pulsation caused by the peeling off of the boundary layer of the turbulent flow. The discrete tones noise is generated because of the periodical vibration of the equiangular blades, which relates to the blade passing frequency (the number of the blades multiplied by the rotation speed) of the impeller.

Consequently, the noise problem in this kind of machine is solved by respectively reducing the broadband noise and discrete tones noise. However, it is difficult for the practical design to reduce the broadband noise by changing the hydrodynamics or aerodynamics design of the elements for achieving better design of flow field and machine efficiency. Because the centrifugal machine needs to be driven and adjusted in a wide range, it is not easy to acquire the parameters of operation in a wide range and high efficiency. That will be the key issue for the hydrodynamics or aerodynamics design.

Other conventional methods for reducing discrete tones noise are also adopted, such as U.S. Pat. No. 3,635,579 as shown in FIG. 4. A soundproof casing 20 is additionally arranged outside the volute casing for reducing the operation noise of the impeller of the centrifugal machines. However, this method can't meet the requirements of batch producing because of its disadvantages of complicated structure and high cost.

An alternative method is disclosed in U.S. Pat. No. 4,411,592 as shown in FIG. 5, wherein an absorber material 25 is additionally arranged in a runner of an erect wall of the diffuser and the outlet of the impeller, for reducing noise. Similar designs are also disclosed in U.S. Pat. Nos. 4,504,188 and 5,249,919. Although noise can be reduced in such designs, the impedance of the runner will thus increase, and the operating efficiency will thus degrade, which can not meet practical requirements either.

It is the key issue to design a type of centrifugal impeller for the conventional centrifugal machines not only to solve the operating noise problems but also to meet the requirement of design cost and flow impedance.

SUMMARY OF THE INVENTION

Regarding the drawbacks of the abovementioned conventional technologies, one of the objectives of this invention is to provide a centrifugal impeller, which can reduce the operating noise.

Another object of this invention is to provide a centrifugal impeller, which can reduce the sound pressure level of tones noise.

Still another object of this invention is to provide a centrifugal impeller, which takes design cost into consideration.

Still another object of this invention is to provide a centrifugal impeller, which can enhance the balance of rotation.

In accordance with the above and other objectives, this invention proposes a centrifugal impeller employed in a centrifugal machine, comprising a main body, the main body generally being conical and defining a shaft bore in a center portion thereof; a shaft extending through the shaft bore of the main body; and a plurality of blade groups evenly arranged surrounding the shaft bore in sequence, each of the blade groups having a plurality of blades wherein neighboring blades having an interval angle, and the number and corresponding interval angles of the blades of different blade groups are identical.

The present invention proposes another centrifugal impeller employed in a centrifugal machine, comprising: a main body defining a shaft bore in a center portion thereof; a plurality of blades arranged surrounding the shaft bore in sequence, neighboring blades have different interval angles; and a center of mass adjusting unit arranged on the main body for adjusting the mass distribution of centrifugal impeller to the rotation axis of the impeller.

Consequently, the feature of the present invention is the position and interval design of the blades surrounding the shaft The main body is evenly divided into a plurality of segments. The neighboring blades of each segment have different angle intervals. And, the number and angle interval of the blades for different segments are identical.

The neighboring blades of each blade group have different interval angle. It means that the interval angle of the neighboring blades has a constantly incremental angle.

Additionally, the center of mass adjusting unit is a mass block arranged on the edge of the main body where there are no blades on it.

Consequently, the design of the present invention forms a periodically changed impeller structure whose blades have different angle intervals. The concentrated energy of the discrete tones noise generated by the rotating blades of the impeller can be efficiently distributed to the sideband frequency of the blades passing frequency and the other harmonic frequencies. The sound pressure level of the discrete tones noise is reduced. Thus the operating noise problem of the centrifugal machine is solved.

DETAILED DESCRIPTION OF THE PREFERRED EMBODIMENTS

The following embodiments are used to describe the present invention; those skilled in the art can easily understand other advantages and functions of the present invention via the contents disclosed in the description. Various embodiments can be employed in the present invention; and the detail of the description can be based on and employed in various points of view, which can be modified within the scope of the present invention.

Figure 6B:
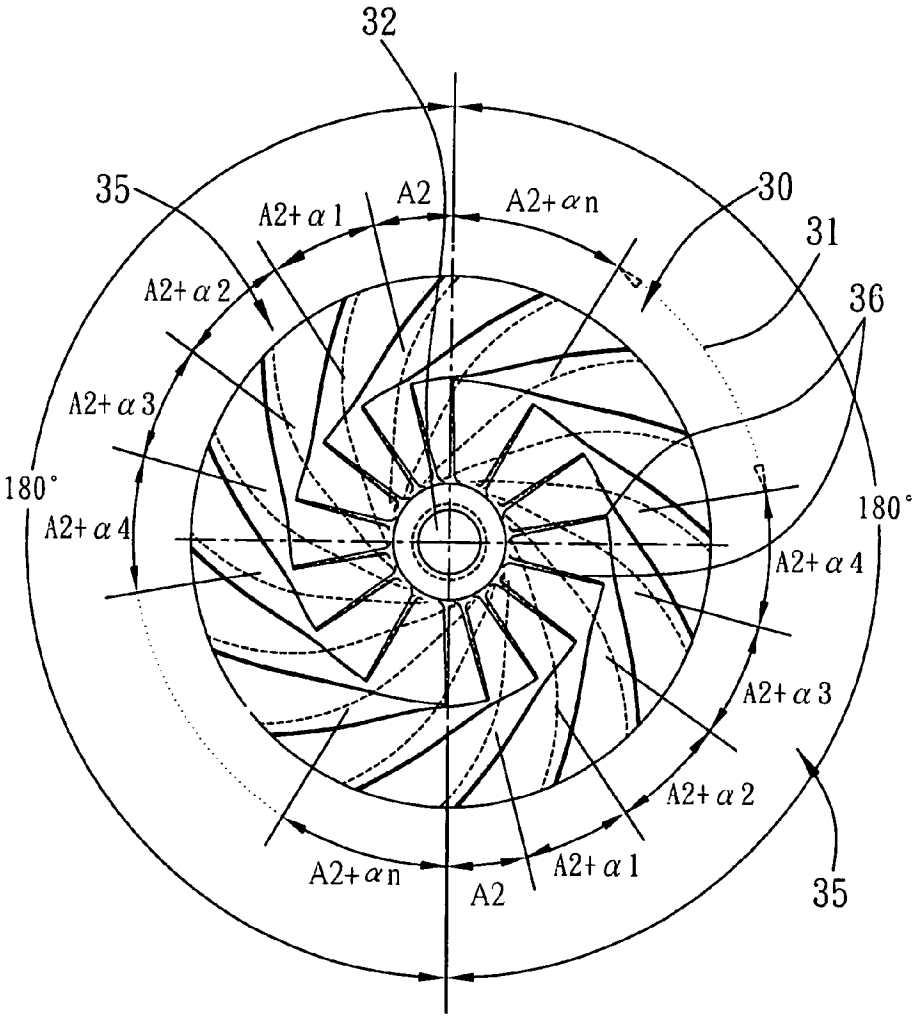
FIGS. 6A and 6B are two schematic views of the centrifugal impeller in accordance with a preferred embodiment of the present invention.
Figure 6A:
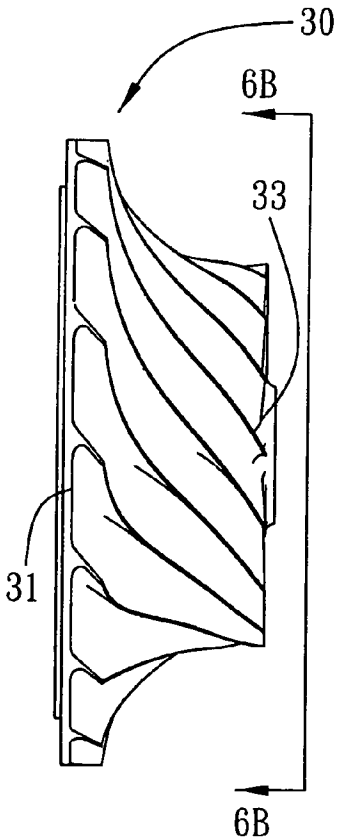

The centrifugal impeller 30 of the present invention is employed in the abovementioned conventional centrifugal machine, and has a structure shown in FIGS. 6A and 6B. The centrifugal impeller 30 comprises a conical impeller main body 31. A shaft bore 32 is installed in a center portion of the conical impeller main body 31 for a shaft 33 to pass. The shaft 33 is perpendicular to a plane where the conical impeller main body 31 is disposed on. The conical impeller main body 31 is evenly divided into a plurality of segments. In a first embodiment shown in the figures, the main body 31 is evenly divided into two segments. Two blade groups 35 are arranged surrounding the shaft 33 in sequence. Each of the two blade groups 35 comprises a plurality of blades 36 spaced at different angle intervals. The blades 36 have an interval angle which is a constant increment angle of $\alpha$ (the angle increase can also be designed to be different). The two blade groups 35 have the same number of blades 36 and angle intervals. That is, the blades 36 of the two blade groups 35 are 180 degrees symmetrical to each other.

Consequently, the feature of the present invention is that the blades 36 are disposed surrounding the shaft 33 and have different interval angle intervals. Moreover, each of the segments has the same number and angle intervals.

The present invention provides an impeller structure having a plurality of periodically disposed but unequally spaced blades 36, for distributing the concentrated energy of the discrete tones noise generated by the high-speed rotating impeller to the sideband frequency of the blades passing frequency and other harmonic frequencies. Therefore, sound pressure level of the discrete tones noise is thus decreased, and the operating noise of the centrifugal machine is thus reduced.

Figure 1:
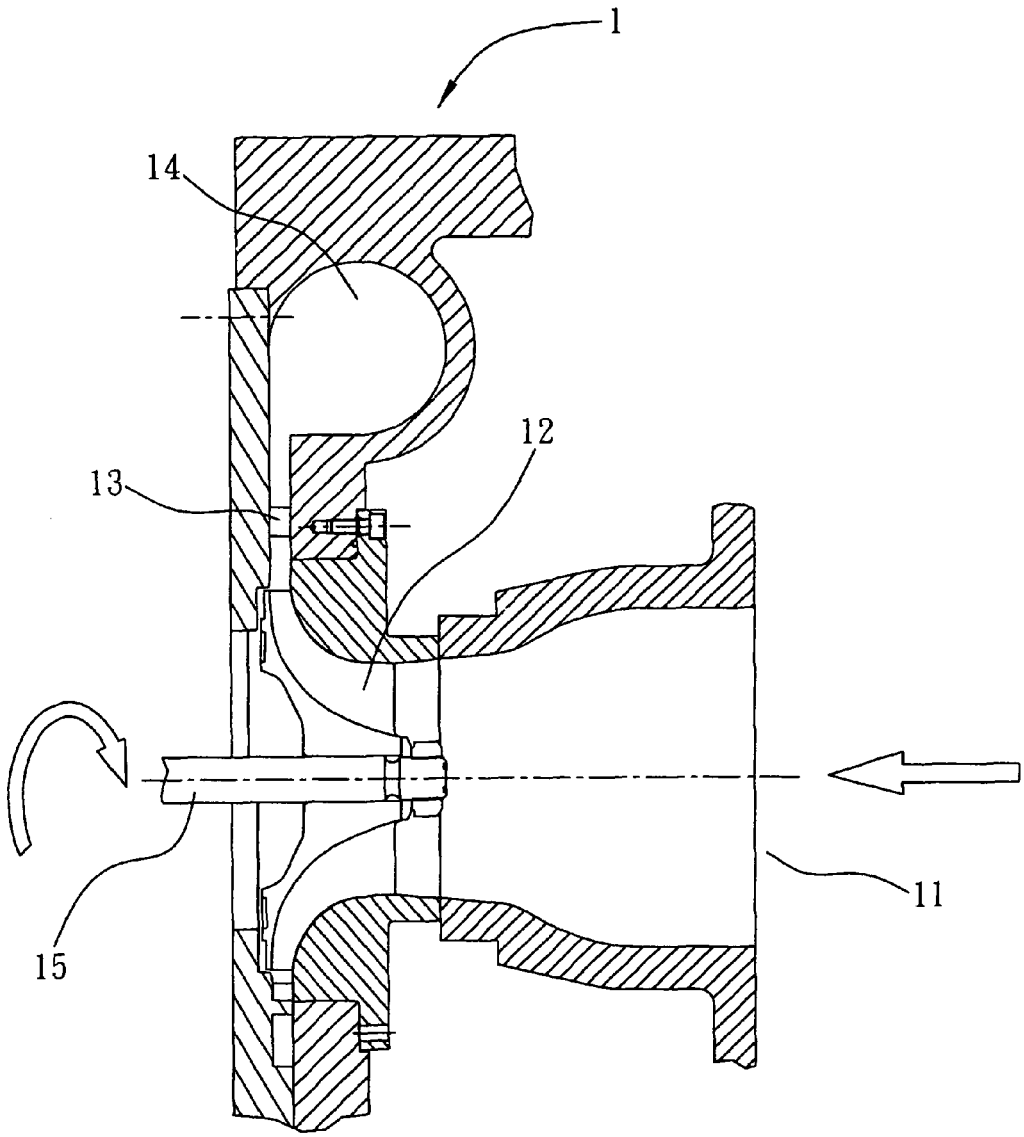
FIG. 1 (PRIOR ART)
FIG. 1 is a sectional view of conventional centrifugal machine.
Figure 2A:
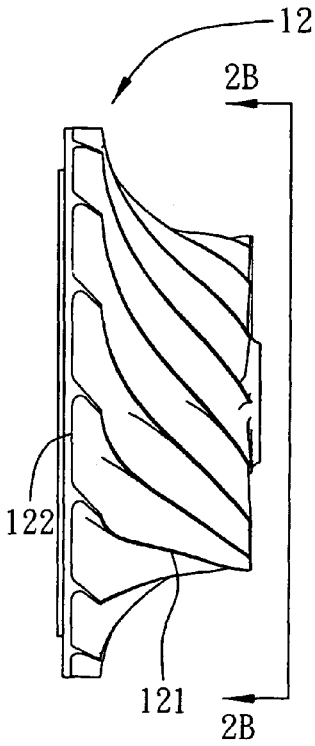
FIG. 2A (PRIOR ART)
FIGS. 2A and 2B are two schematic view of a structure of the centrifugal shown in FIG. 1.
Figure 2B:
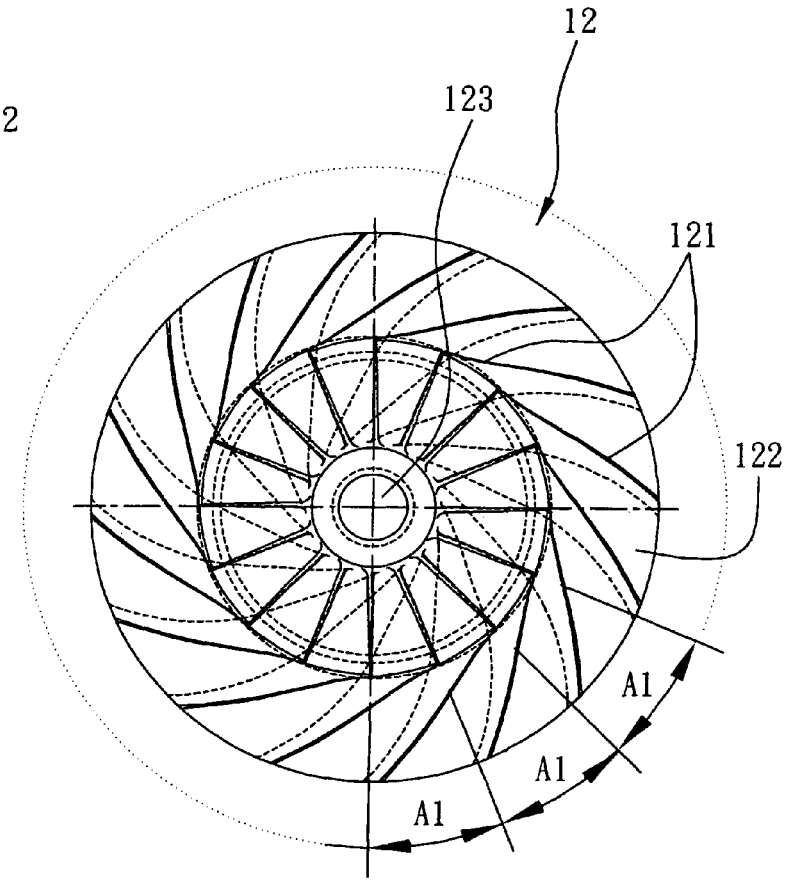
FIG. 2B (PRIOR ART)
Figure 3:
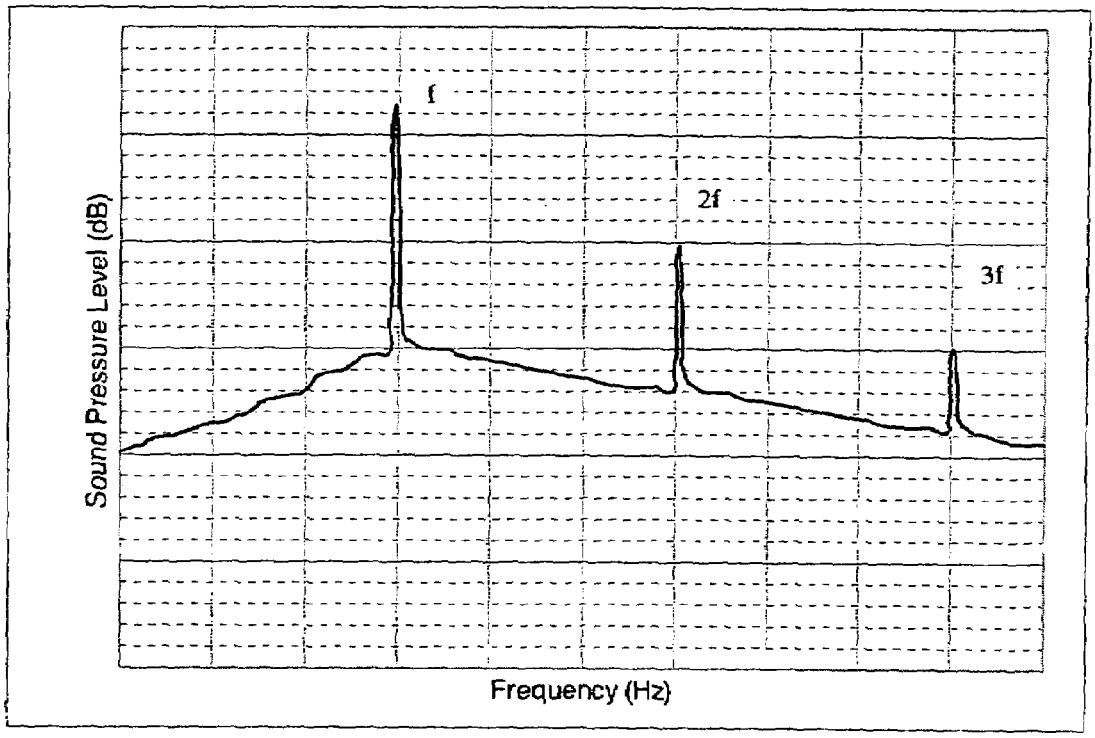
FIG. 3 (PRIOR ART)
FIG. 3 is a noise spectrum diagram of the centrifugal machine shown in FIG. 1.
Figure 4:
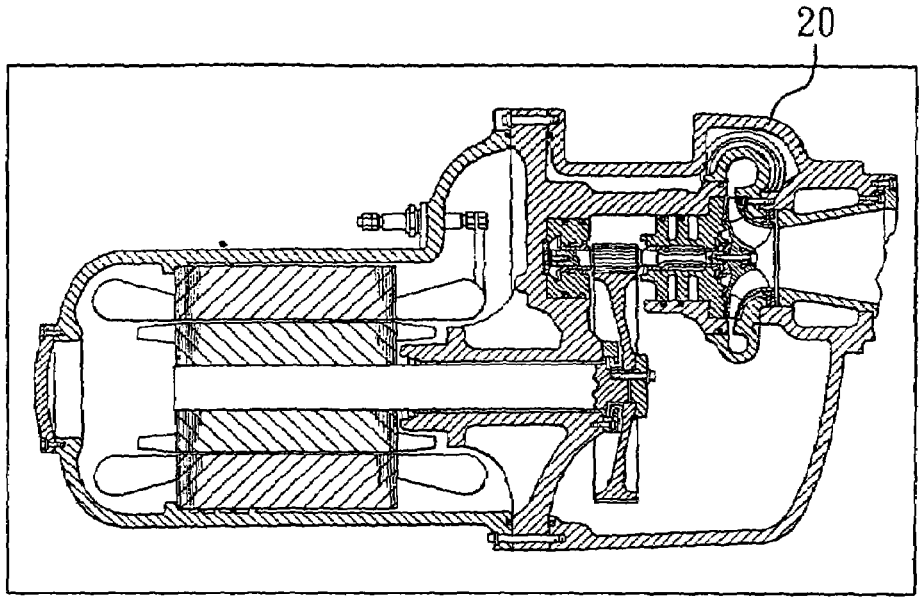
FIG. 4 (PRIOR ART)
FIG. 4 is a section view of the centrifugal machine of U.S. Pat. No. 3,635,579.
Figure 5:
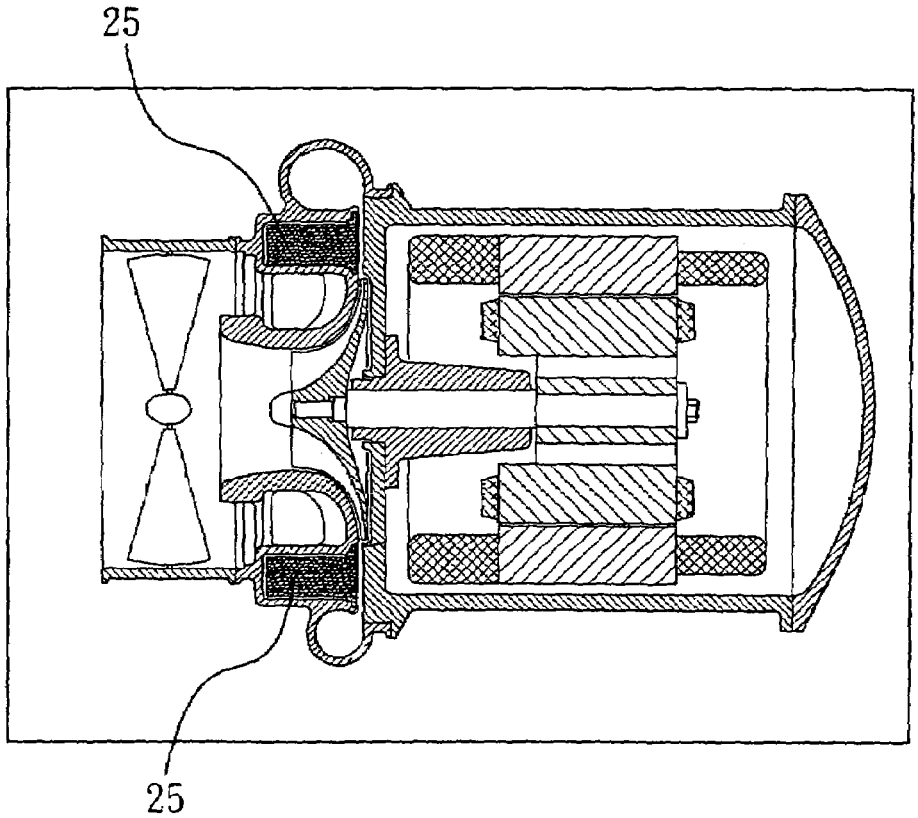
FIG. 5 (PRIOR ART)
FIG. 5 is a section view of the centrifugal machine of U.S. Pat. No. 4,411,592.
Figure 7:
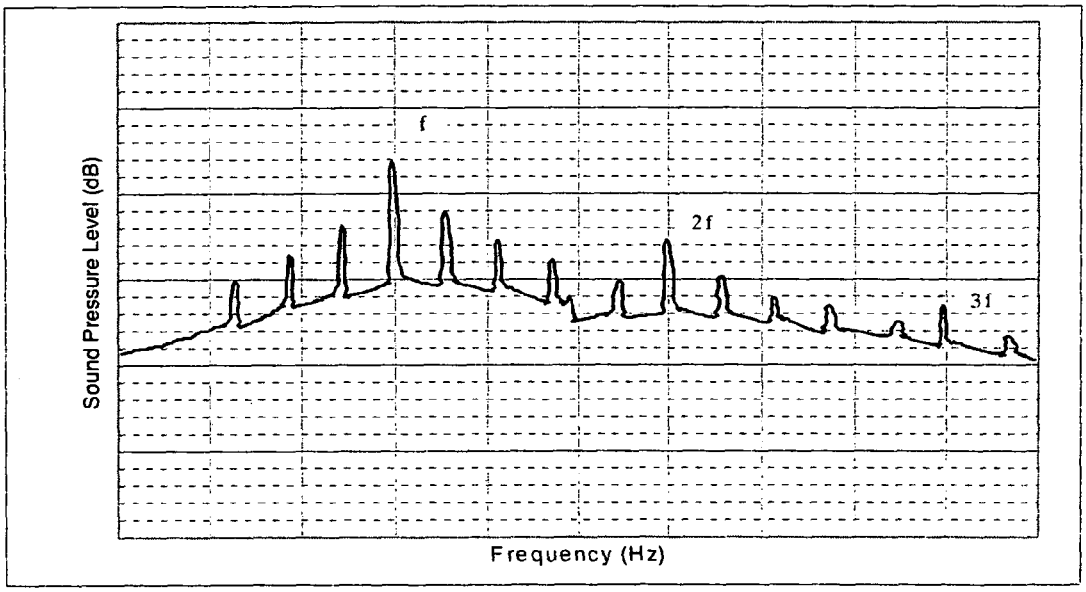
FIG. 7 is a noise spectrum of the centrifugal machine shown in FIG. 6A and FIG. 6B.

FIG. 7 is a noise spectrum of the centrifugal machine employing the designed structure of the present invention. Compared to the spectrum of conventional structure (shown in FIG. 3), the noise spectrum of the present invention shows that the sound pressure level of the single frequency is significantly reduced.

Figure 8:
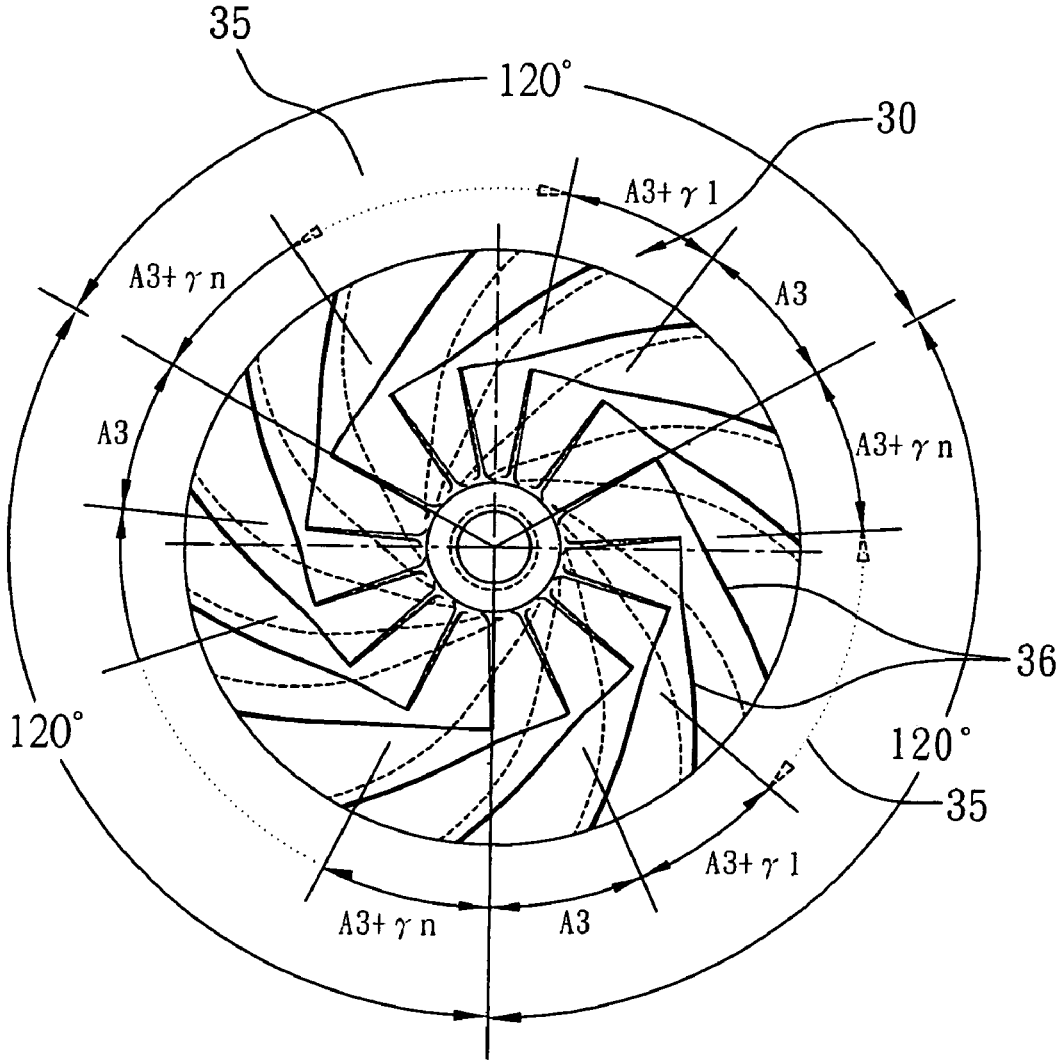
FIG. 8 is a schematic view of the centrifugal impeller in accordance with a second embodiment of the present invention.

According to the present invention, the main body 31 can be evenly divided into another number, in addition to two as described above, segments. In a second embodiment as shown in FIG. 8, the main body 31 is evenly divided into three segments, and three blade groups 35 are therefore formed. In the same scenario, neighboring blades 36 of each of the three blade groups 35 have an interval angle which is a constant increment angle of y, and the number and angle interval of the blades 36 of each of the blade groups 35 are identical. That is, the blades 36 of the three blade groups 35 are 120 degrees symmetrical to one another.

Figure 9:
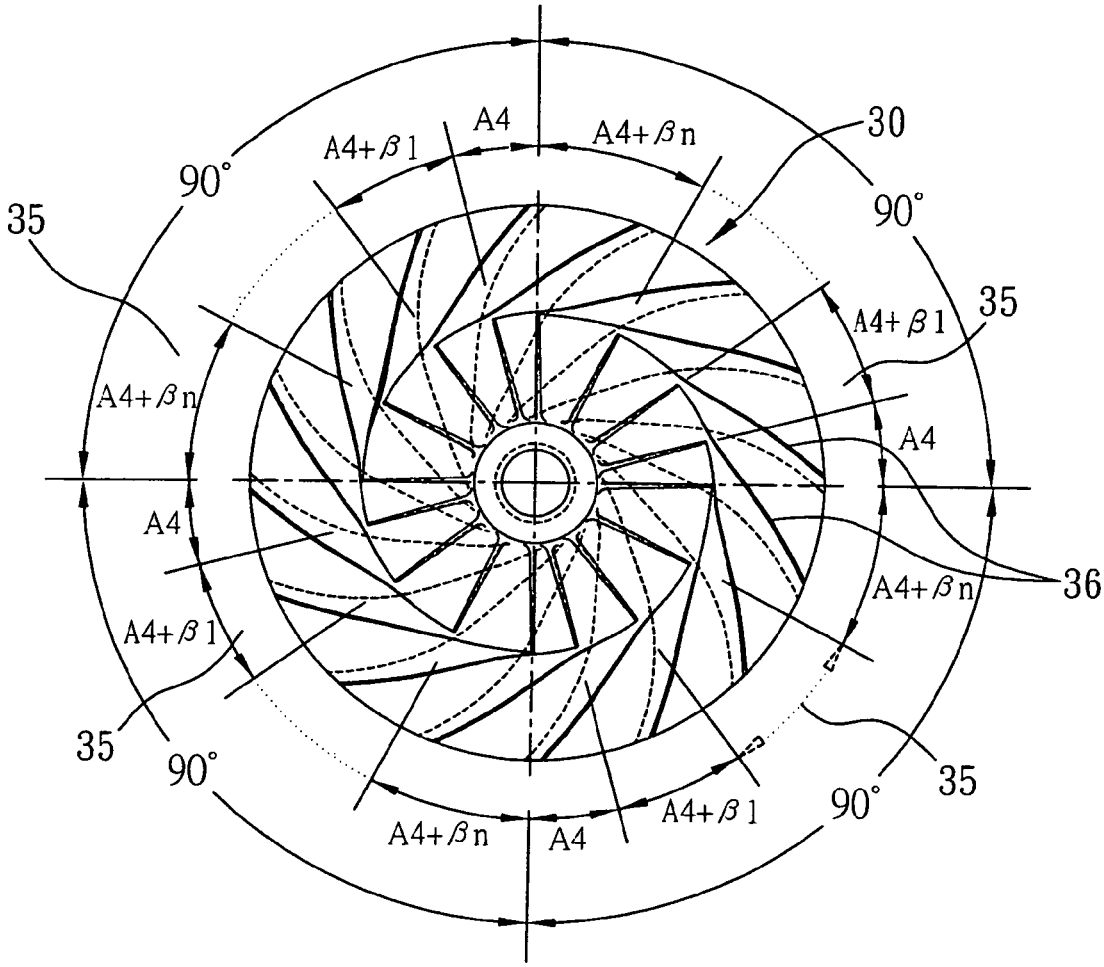
FIG. 9 is a schematic view of the centrifugal impeller in accordance with a third embodiment of the present invention.

Alternatively, a third embodiment as shown in FIG. 9, the main body 31 is evenly divided into four segments, and four blade groups 35 are therefore formed. Neighboring blades 36 have an interval angle which is a constant increment angle of $\beta$, and the number and angle interval of the blades 36 of each of the blade groups 35 are identical. That is, the blades 36 of the four blade groups 35 are 90 degree symmetrical to one another.

Figure 10B:
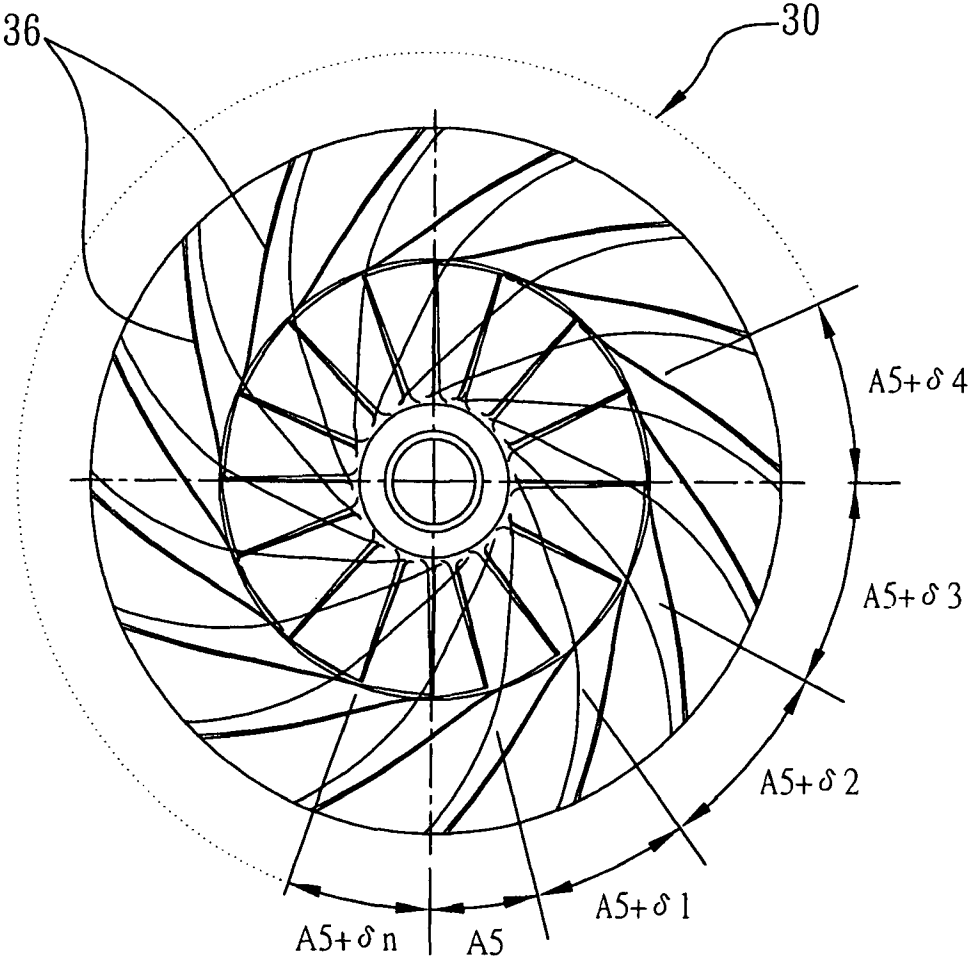
FIGS. 10A and 10B are two schematic views of the centrifugal impeller in accordance with a fourth embodiment of the present invention.
Figure 10A:
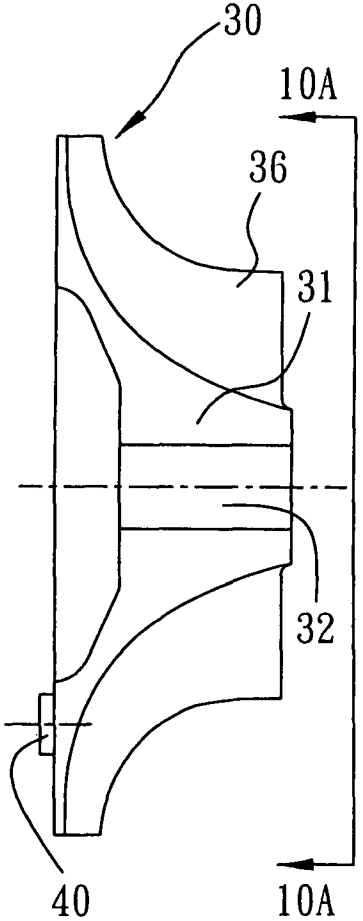

Consequently, there is no limit to the number of the blade groups 35 of the present invention, the main body 31 can also be evenly divided into other number of segments and therefore the number of blade groups are formed, as long as a periodically changed impeller structure whose blades having different angle intervals is formed. Additionally, it is not necessary for the angle interval of neighboring blades 36 in a same blade group to have an increment angle of $\alpha$, any other angle interval can also be adopted, as long as the corresponding angle intervals of the blades 36 of different blade groups are identical. An embodiment as shown in FIG. 10A, 10B can also be adopted in the present invention. The main body 31 is not divided, while a plurality of blades 36 are arranged surrounding the conical main body 31, and neighboring blades 36 have a different angle interval (for example, have an increment angle). However in this embodiment, there is no symmetrical balance center of mass for the plurality of blade groups, thus a center of mass adjusting unit 40, such as a mass block, needs to be additionally arranged for adjusting the center of mass of the centrifugal impeller 30 to the shaft 22. Wherein the center of mass adjusting unit 40 is approximately arranged near the edge of the main body 31, and on the surface of the main body 31 where the blades 36 are not arranged, the configuration of the position thereof and the blades 36 is related to the mass of the center of mass adjusting unit 40.

It should be apparent to those skilled in the art that the above description is only illustrative of specific embodiments and examples of the present invention. The present invention should therefore cover various modifications and variations made to the herein-described structure and operations of the present invention, provided they fall within the scope of the present invention as defined in the following appended claims.

What is claimed is:

1. A centrifugal impeller employed in a centrifugal machine, the centrifugal impeller comprising:

a conical main body having a shaft bore in a center portion thereof; and at least first and second blade groups evenly arranged surrounding the shaft bore in sequence, each of the blade groups having a plurality of blades, each adjacent blade in the first blade group being disposed at a first constant increment angle from each other, each adjacent blade in the second blade group being disposed at a second constant increment angle, and the first blade group and the second blade group having a different number of blades from each other, with the blades of the first group being closer to each other than the blades of the second group.

2. The centrifugal impeller as claimed in claim 1, wherein angles between adjacent blades of the pairs of neighboring blades of each of the blade groups are disposed at sequentially increasing interval angle at a distance of the increment angle.

3. The centrifugal impeller as claimed in claim 1, wherein interval angles between adjacent blades of the pairs of neighboring blades of each of the blade groups are based on the increment angle.

4. The centrifugal impeller as claimed in claim 1, wherein the centrifugal impeller has two blade groups, and the blades of the two blade groups are disposed symmetrically opposite to each other.

5. The centrifugal impeller as claimed in claim 1, wherein the centrifugal impeller has three blade groups, and the blades of the three blade groups are symmetrical to one another every 120 degrees.

6. The centrifugal impeller as claimed in claim 1, wherein the centrifugal impeller has four blade groups, and the blades of the four blade groups are symmetrical to one another every 90 degrees.

7. The centrifugal impeller as claimed in claim 1, wherein each of the blades is approximately perpendicular to the plane where the main body is located.

8. The centrifugal impeller as claimed in claim 1, wherein the main body is circular.

9. The centrifugal impeller as claimed in claim 1 wherein the first blade group and the second blade group are disposed on opposite sides of the conical main body.

* * * * *